US005421059A

United States Patent [19]

Leffers, Jr.

[11] Patent Number: 5,421,059

[45] Date of Patent: Jun. 6, 1995

[54] TRAVERSE SUPPORT ROD

[76] Inventor: Murray J. Leffers, Jr., 1006 E. Bluefield, Phoenix, Ariz. 85022-1322

[21] Appl. No.: 64,889

[22] Filed: May 24, 1993

[51] Int. Cl.[6] ..... A47H 13/12; A47H 15/04

[52] U.S. Cl. ..... 16/87.40 R; 24/614; 362/253; 160/330

[58] Field of Search ..... 16/87.4 R, 87 R, 96 R, 16/96 D, 96 L; 24/614, 615, 625; 362/253, 145; 160/330, DIG. 6

[56] References Cited

U.S. PATENT DOCUMENTS

| | | | |
|---|---|---|---|
| 537,422 | 4/1895 | Kull | 16/87.4 R |
| 904,229 | 11/1908 | Robinson | 16/87.4 R |
| 1,786,787 | 12/1930 | Steinmeyer | 362/145 |
| 2,320,308 | 5/1943 | Silverman | 16/87.4 R |
| 2,713,899 | 7/1955 | Holloway et al. | 16/87.4 R |
| 2,787,070 | 4/1957 | Idoine | 362/253 |
| 2,848,735 | 8/1958 | Ault et al. | 16/87.4 R |
| 3,766,597 | 10/1973 | Ford et al. | 16/87.4 R |
| 4,970,762 | 11/1990 | Oreck et al. | 24/625 |

FOREIGN PATENT DOCUMENTS

| | | | |
|---|---|---|---|
| 677181 | 12/1963 | Canada | 16/87.4 R |
| 863140 | 3/1961 | United Kingdom | 16/87.4 R |

*Primary Examiner*—P. Austin Bradley
*Assistant Examiner*—Chuck Y. Mah
*Attorney, Agent, or Firm*—Parsons & Associates; Don J. Flickinger; Robert A. Parsons

[57] ABSTRACT

A tubular member divided into a top portion and a bottom portion by a divider. A longitudinal opening formed in the bottom portion of the tubular member. A glider slidably received within the bottom portion of the tubular member. A clip, for supporting a sheet material, is deformable between a locking position and an unlocking position, and has engagement portions which removably couple the clip to the glider.

19 Claims, 3 Drawing Sheets

FIG. 7
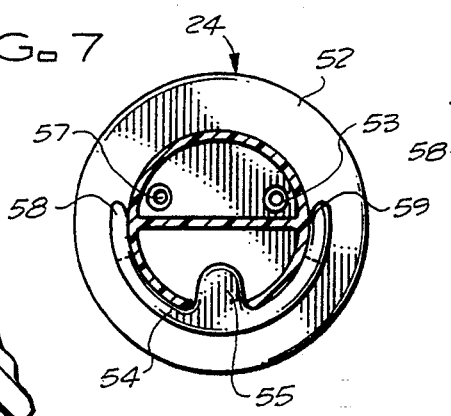
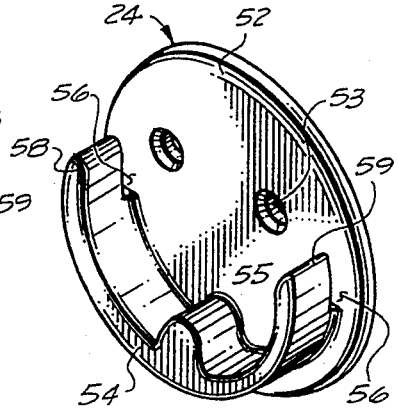
FIG. 8
FIG. 9
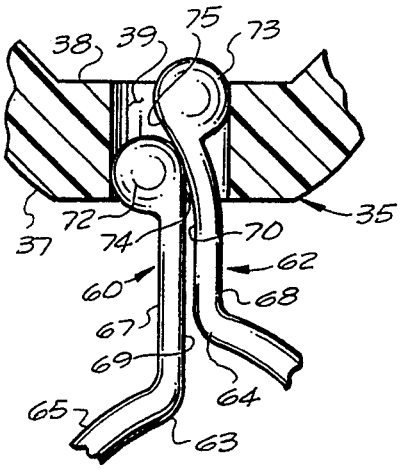
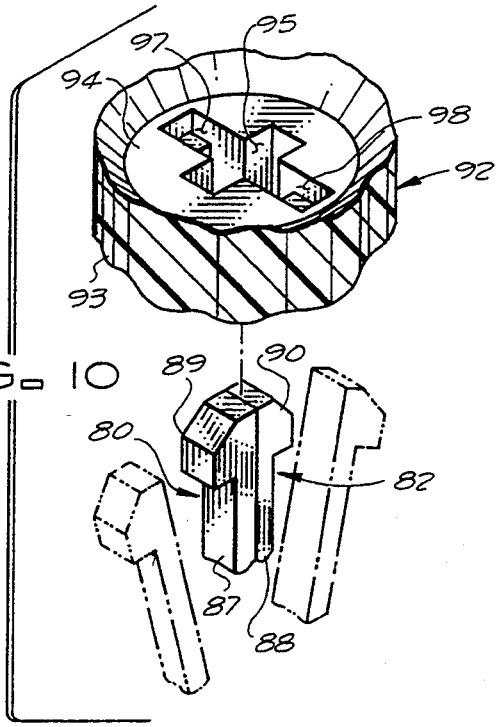
FIG. 10
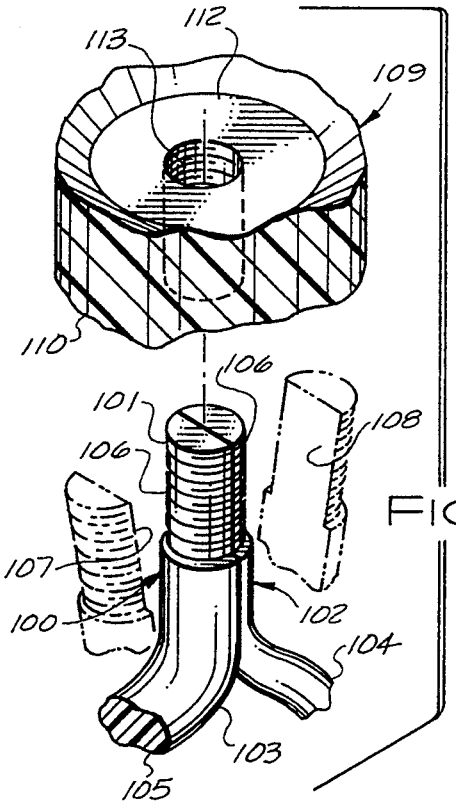
FIG. 11
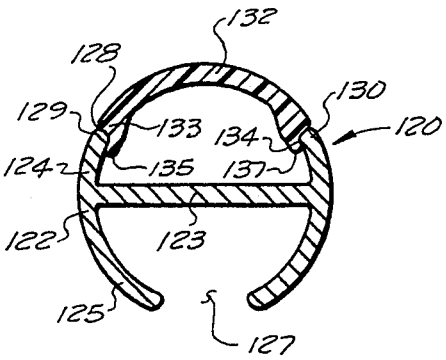
FIG. 12

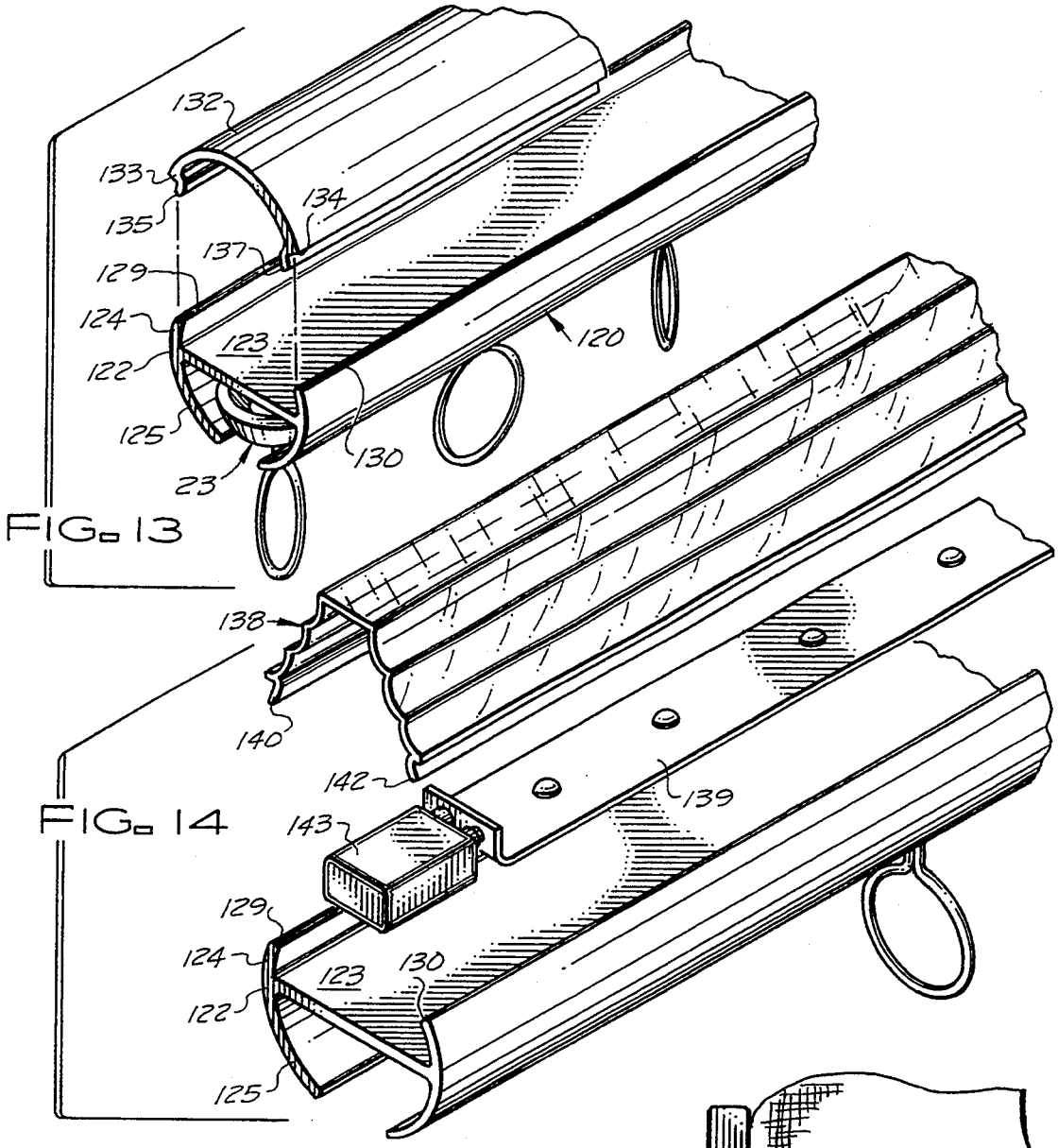
FIG. 13
FIG. 14
FIG. 15
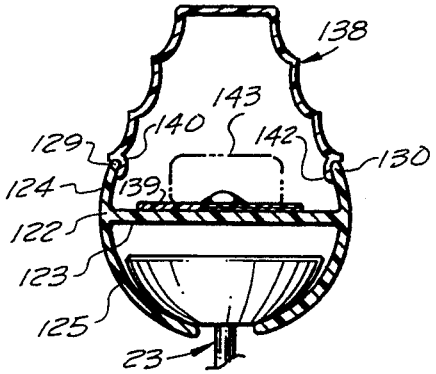
FIG. 16
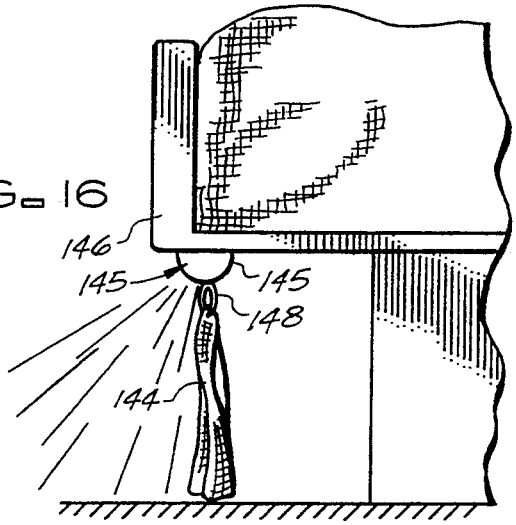

TRAVERSE SUPPORT ROD

BACKGROUND OF THE INVENTION

Field of the Invention

This invention relates to traverse support rods.

More particularly, the present invention relates to rods which slidably support sheet material.

In a further and more specific aspect, the present invention concerns a traverse support rod for hanging curtains and the like.

The Prior Art

Traverse support rods are well known and have many uses. Their greatest utility is for supporting sheet material such as curtains. One example of such is a rod to support a shower curtain. Typically, these rods are constructed of plastic or metal and are supported between opposing walls. Various attachment devices have been developed to attach a shower curtain to the rod. While these devices are varied, there is a general requirement that the curtain be slidably movable along the rod from one end to the other. This feature allows the shower curtain to be moved from one end to the other and allows any portion of the rod to support the curtain, closing a desired area. To obtain this desirable capability, a great many attachment devices consist of rings which fit around the rod, and freely slide along its length. Many have eyelets which receive a hook. The hook is also received through an eyelet formed in the curtain. In this manner, curtains are slidably attached to rods.

While these devices have the benefit of being simple, they are sometimes considered to detract from the general decor of a room. Furthermore, and more importantly, many of the devices which consist of rings must be fitted over an end of the rod. This can become a very bothersome and time consuming procedure if a centrally located ring is broken and must be replaced. If this should occur, or a ring must be replaced for any reason, the rod must be removed from its supports and taken down. All of the rings up till the ring which is to be replaced must be removed. The ring must then be replaced, and all of the proceeding rings must then be returned. In other words, any one ring cannot be removed and replaced without a great amount of effort.

To overcome this problem, rings have been developed which are split. The split ends of the ring are forced apart and placed around the rod. One of these ends may also be passed through an eyelet in the shower curtain thereby attaching the curtain to the rod. The split ends of the ring can then be reconnected, generally with a ball and socket friction coupling, securing the ring over the rod and retaining the curtain. While any one of these rings may be replaced without removing the rod or any other of the rings, they can be difficult to use. A person may have difficulty forcing the ends apart far enough to fit over the rod, and once in place, the ends may be difficult to force together. If the fit between ends is not tight enough, they may come apart easily when the curtain is moved. However, a sufficiently tight fit may make disconnecting and connecting the ends difficult.

It would be highly advantageous, therefore, to remedy the foregoing and other deficiencies inherent in the prior art.

Accordingly, it is an object of the present invention to provide improvements in traverse rods.

Another object of the present invention is to provide an improved traverse support rod.

A further object of the present invention is to provide a traverse rod having attachment members for slidably supporting a sheet material.

And another object of the present invention is to provide a curtain rod having easily removable attachment members.

Still another object of the present invention is to provide a curtain rod having individually removable attachment members.

Yet another object of the present invention is to provide a curtain rod which is esthetically pleasing.

Yet still another object of the present invention is to provide a curtain rod which has interchangeable decorating features.

SUMMARY OF THE INVENTION

Briefly, to achieve the desired objects of the present invention in accordance with a preferred embodiment thereof, provided is an elongate member having a first end and a second end. The elongate member is preferably of a generally tubular shape with a longitudinal opening extending from the first end to the second end. An attachment member including a glider and a clip is coupled to the elongate member for slidably coupling a sheet material to the elongate member. The glider is generally hemispherical, and slideably received within the elongate member. The clip is expandable to receive the sheet material, and includes a pair of locking members. The locking members removably couple the clip to the glider, with the clip extending outwardly through the longitudinal opening in the elongate member. A substantially horizontal divider dividing the elongate member into a top portion and a bottom portion may also be provided. The longitudinal opening is formed in the bottom portion.

Also provided in a more specific embodiment is a second longitudinal opening formed in the top portion. An interchangeable decorative cap is configured to be received by and close the second longitudinal opening. A light element can be carried by the divider for providing a decorative glow.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 7 is a sectional end view of the traverse rod received in a support fixture;

FIG. 8 is a perspective view of the support fixture;

FIG. 9 is a sectional side view of locking members of the clip unlocked from a glider;

FIG. 10 is a partial perspective view of a further embodiment of the locking members of the attachment member;

FIG. 11 is a partial perspective view of a further embodiment of the locking members of the attachment member;

FIG. 12 is a sectional end view of a further embodiment of the traverse support rod without attachment members;

FIG. 13 is a perspective view of the traverse support rod illustrated in FIG. 12, with attachment members;

FIG. 14 is a perspective view of the traverse support rod illustrated in FIG. 13 having an alternate embodiment of a cap, and including a light feature;

FIG. 15 is a sectional end view of the traverse rod illustrated in FIG. 14; and

FIG. 16 illustrates a further use of a traverse support rod.

DETAILED DESCRIPTION OF THE PREFERRED EMBODIMENT

Figure 1:
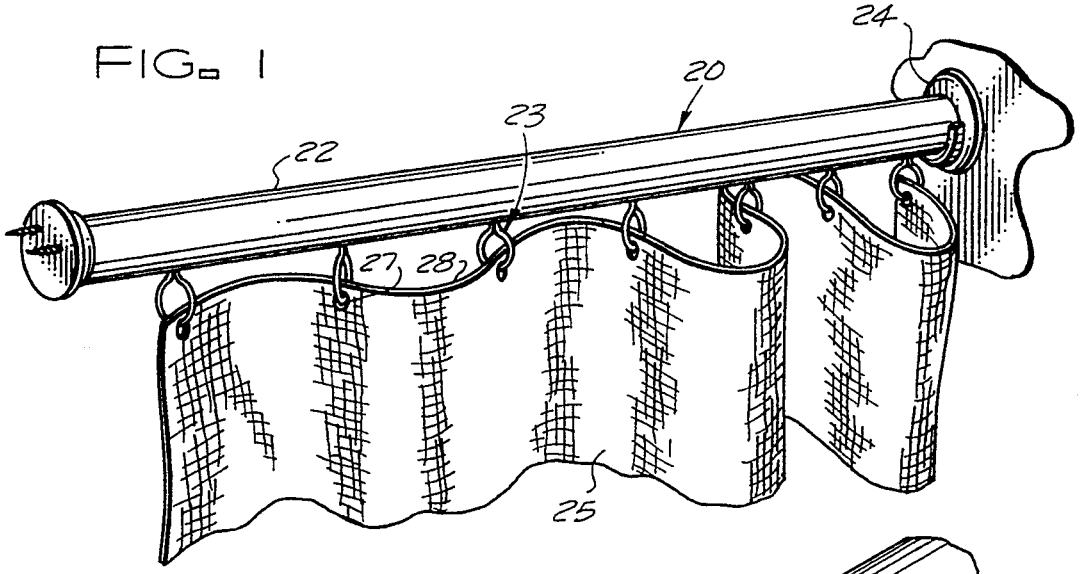
FIG. 1 is a perspective view of a traverse support rod, constructed in accordance with the teachings of the present invention, as it would appear supporting a curtain.

Turning now to the drawings in which like reference characters indicate corresponding elements throughout the several views, attention is first directed to FIG. 1 which illustrates a traverse support rod generally designated by the reference character 20. Traverse support rod 20 includes an elongate member 22 and a plurality of attachment members 23. Elongate member 22 is attached to opposing surfaces by support fixtures 24. In this preferred embodiment, traverse support rod 20 is supporting a curtain 25. Curtain 25 may be any of a wide variety of curtains, including but not limited to shower curtains, and has a plurality of eyelets 27 formed along an upper edge 28. attachment members 23 are received through eyelets 27, attaching curtain 25 to elongate member 22.

Figure 3:
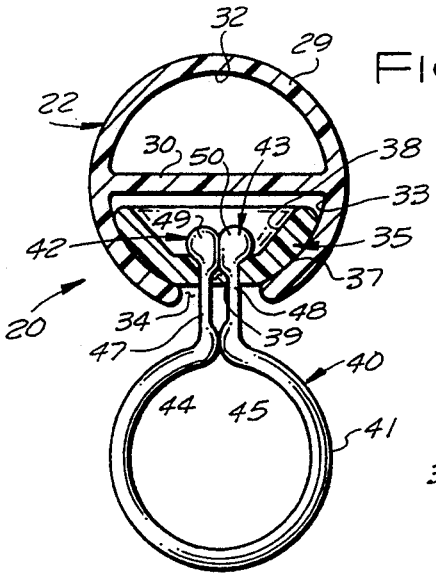
FIG. 3 is a sectional end view of the traverse support rod.
Figure 2:
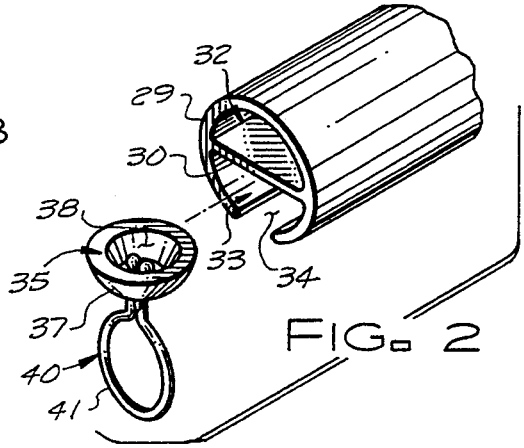
FIG. 2 is a partial perspective view of an end of the traverse support rod and an attachment member.

Referring now to FIGS. 2 and 3, elongate member 22 includes a cylindrical tube 29 bisected by a horizontal divider 30 into a top portion 32 and a bottom portion 33. Bottom portion 33 has a longitudinal opening 34 which acts as a track for attachment members 23. While it is preferred, it is not necessarily required that divider 30 bisect cylindrical tube 29. The purpose of divider 30 is to maintain the structural integrity of cylindrical tube 29. It provides strength to cylindrical tube 29 weakened by longitudinal opening 34 and therefore may simply divide cylindrical tube 29 into unequal portions.

Attachment members 23 include a glider 35 which is generally hemispherical, having a convex surface 37 which rides within bottom portion 33 and an opposing inset surface 38. A central opening 39 is formed through glider 35 at its apex, between convex surface 37 and inset surface 38. A clip 40, including a ring 41 and locking members 42 and 43 extending therefrom is removably coupled to glider 35 by inserting locking members 42 and 43 through opening 39. Glider 35 is slidably receivable within bottom portion 33 of cylindrical tube 29 with clip 40 extending downward past longitudinal opening 34.

Figure 5:
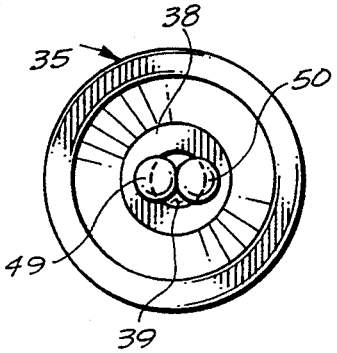
FIG. 5 is a top view of an attachment member.
Figure 4:
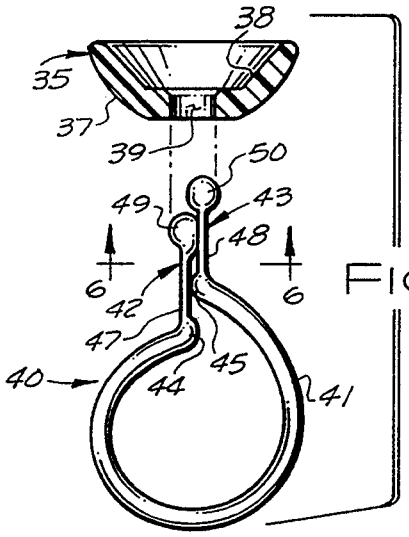
FIG. 4 is an end view of an attachment member with the clip detached.
Figure 6:
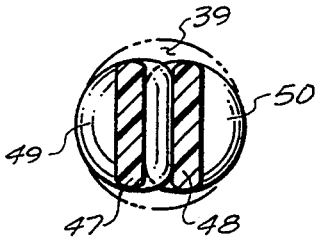
FIG. 6 is a sectional view taken along line 6—6 of FIG. 4

Turning now to FIG. 4, ring 41 of clip 40 is split, forming adjacent ends 44 and 45 which are expandable, allowing one of ends 44 and 45 to be inserted through eyelets 27 of curtain 25. Locking members 42 and 43 extend from ends 44 and 45 respectively for attaching clip 40 to glider 35. Locking members 42 and 43 consist of stems 47 and 48 extending generally radially outward from ends 44 and 45 respectively in a substantially parallel relationship and terminating in enlarged ends 49 and 50 which, in this embodiment, are engagement portions configured to couple clip 40 to glider 35. clip 40 is constructed of flexible material deformable between a locking position and an unlocking position. The material has a memory, and will return to the locked position in which ends 44 and 45 abut with stems 47 and 48 substantially parallel. Enlarged ends 49 and 50 abut and combine to have a width greater than the diameter of opening 39 as can be seen with reference back to FIG. 3. Upon deformation of ring 40 as illustrated in FIG. 4 and 6, one of enlarged ends 49 and 50 is displaced back toward the opposing end of ring 40 and is received against the opposing stem. In this position, the width of combined enlarged ends 49 and 50 is less than the diameter of opening 39. In this manner, enlarged ends 49 and 50 of locking members 42 and 43 can be inserted through opening 39. Once inserted through opening 39, clip 40 will automatically return to the lock position described above. When this occurs, locking members 42 and 43 cannot be withdrawn from glider 35, since their combined width is greater than the diameter of opening 3-9. This can be seen in FIG. 5, with enlarged ends 49 and 50 extending through opening 39 and received against inset surface 38.

As described above, traverse rod 20 is supported by support fixtures 24 coupled to opposing surfaces. Referring to FIGS. 7 and 8, support fixtures 24 include a disk 52 having countersunk screw holes 53 extending therethrough. A semi-circular extension 54 extends from disk 52 for receiving and cradling bottom portion 33 at the ends of elongate member 22. A tab 55 extends upward from extension 54 and is configured to be received by longitudinal opening 34. Tab 55 positions elongate member 22 in the proper orientation so as to allow attachment members 23 to depend downward therefrom and to prevent rotation of traverse support rod 20. To insure a secure fit, cuts 66 are formed between ends 58 and 59 of extension 54 and disk 52. This allows a slight outward movement of ends 58 and 59, providing a snap type fit between the end of elongate member 22 and support fixture 24. Support fixtures 24 are attached to opposing surfaces by screws 57 extending through countersunk holes 53 and into the surfaces.

An alternate embodiment of locking members can be seen with reference to FIG. 9. In this embodiment, a pair of locking members 60 and 62 extend from ends 63 and 64 of ring 65 as do locking members 42 and 43 from ring 41. Locking members 60 and 62 differ from locking members 42 and 43 in that they include stems 67 and 68 having adjacent surfaces 69 and 70 which are substantially coplanar. Stems 67 and 68 terminate in engagement portions, which in this embodiment are enlarged ends 72 and 73. Enlargements 72 and 73 are directed in an outward direction, and have adjacent surfaces 74 and 75 which are substantially coplanar. Upon deformation of ring 65 as described earlier, locking members 60 and 62 misalign, with one of enlarged ends 72 and 73 sliding toward ring 65 along an opposing one of stems 67 and 68. Assuming locking member 60 slides inward, and locking member 62 extends outward past locking member 60, locking member 62 will flex around enlarged portion 72 of locking member 60 when attempting insertion or extraction from opening 39 of glider 35. This reduces the overall greatest combined width of locking members 60 and 62 to a width capable of passing through opening 39. Once inserted, locking members 60 and 62 return to the locking position and cannot be withdrawn from glider 35, since their combined width is again greater than the diameter of opening 39.

Another embodiment of locking members can be seen with reference to FIG. 10. In this embodiment, a pair of locking members 80 and 82 extend from ends (not visible) of a ring (not visible) as do locking members 42 and 43 from ring 41. Locking members 80 and 82 differ from locking members 42 and 43 in that they include stems 87 and 88 having a generally square cross-section and terminating in engagement portions, which in this embodiment are flanges 89 and 90. Flanges 89 and 90 extend substantially perpendicularly outward from stems 87 and 88 respectively, each in an opposing direction. Locking members 80 and 82 are formed to expand away from one another in a locking position, as is illustrated by broken lines, and may be compressed so as to bring stems 87 and 88 together in an unlocking position. When compressed into the unlocking position, locking members 80 and 82 can be inserted into a glider 92. Glider 92 is substantially identical to glider 35, being generally hemispherical, and having a convex surface 93, which rides within bottom portion 33, and an opposing inset surface 94. A central opening 95 is formed through glider 92 at its apex, between convex surface 93 and inset surface 94. In this embodiment, opening 95 is rectangular and is configured to receive flanges 89 and 90 therethrough in the unlocking position. Indents 97 and 98 are formed in inset surface 94 at right angles to rectangular opening 95. Indents 97 and 98 are configured to receive flanges 89 and 90 respectively. After insertion of locking members 80 and 82 through opening 95, ring 85 is turned a quarter turn. Locking members 80 and 82 will expand to the locking position, with flanges 89 and 90 received in indents 97 and 98. Locking members 80 and 82 cannot be withdrawn until they are compressed into the unlocking position again.

A further embodiment of locking members can be seen with reference to FIG. 11. In this embodiment, a pair of locking members 100 and 102 extend from ends 103 and 104 of a ring 105 as do locking members 42 and 43 from ring 41. Locking members 100 and 102 include stems 106 which have a generally semi-circular cross-section with adjacent, coplanar surfaces 107 and 108. The engagement portions in this embodiment are threads 101 formed on the curved outer surfaces of locking members stems 106. Together, stems 106 have a circular cross-section and have threads 101 which function in a manner similar to a bolt. Locking members 100 and 102 can be separated in order for ring 105 to be inserted through eyelets 27. When positioned together, locking members 100 and 102 can be threaded into a glider 109. Glider 109 is substantially identical to glider 35, being generally hemispherical, and having a convex surface 110, which rides within bottom portion 33, and an opposing inset surface 112. A central opening 113 is formed through glider 109 at its apex, between convex surface 110 and inset surface 112. In this embodiment, opening 113 is tapped to threadably receive the combined locking members 100 and 102.

Referring now to FIG. 12, another embodiment of an elongate member 120 is illustrated. In this embodiment, elongate member 120 is similar to elongate member 22, including a cylindrical tube 122 bisected by a horizontal divider 123 into a top portion 124 and a bottom portion 125. Bottom portion 125 has a longitudinal opening 127 which acts as a track for attachment members 23. Elongate member 120 differs in that it includes a longitudinal opening 128 formed the length of top portion 124 defined by edges 129 and 130. Longitudinal opening 128 is closable by a cap 132 extending along its length to give elongate member 120 a finished look as illustrated in FIGS. 12 and 13. In this embodiment, cap 132 is semicircular and has opposing edges 133 and 134 which engage edges 129 and 130 of top portion 124. Attachment means for attaching cap 132 to top portion 124 may be any known conventional means such as conventional snap fits as illustrated in FIG. 12, wherein ridges 135 and 137, extending along edges 134 and 135, are configured to be received against the inner surfaces of edges 129 and 130 with the application of a slight force such as that applied by hand. This force will cause a slight inward flex of ridges 135 and 137 as they are positioned against edges 129 and 130. When in position, ridges 135 and 137 press against the inner surface of edges 129 and 130 holding cap 132 securely in engagement with top portion 124. Cap 132 can be constructed of a translucent, transparent, or opaque material having different colors or designs, for decorative purposes. This enables elongate member 120 to be changed to match the decor desired. Furthermore, cap 132 is easily removed and replaced by another cap having a different color or design, enabling elongate member 120 to be updated to match changing color or design schemes.

FIGS. 14 and 15 illustrates a further embodiment of a decorative cap 138 for use with elongate member 120, and also includes a light element 139. Cap 138 has a general trough shape with edges 140 and 142 which engage edges 129 and 130 of top portion 124 closing longitudinal opening 128. Those skilled in the art will understand that cap 138 can be substantially any design or shaped, having edges which will engage edges 129 and 130 of top portion 124. Cap 138, in this embodiment has been formed to have a general pogada shaped cross section. Light element 139 can be positioned within top portion 124, covered by cap 138. In this manner, light element 139 will produce a glow through cap 138. In this embodiment, light element 138 is a light strip supported by divider 123 and powered by a 9 volt battery 143. It will be understood, however, that any known light emitting means may be used such as LEDs, incandescent bulbs or fluorescent lights. Furthermore, these may be powered by a variety of conventional sources.

Traverse rod 20 may be used to support a wide variety of objects, conventional or other, such as to hang a tapestry or many other items. It may also be used to support a dust ruffle 144 or other such articles as shown in FIG. 16. A traverse rod 145 is shown coupled to the underside of a bed frame 146, supporting dust ruffle 144. Traverse rod 145 includes an elongate member 147 and clip 148. Elongate member 147 is substantially identical to elongate member 120, with bed frame 146 replacing cap 132. Clip 148 is substantially identical to clip 40. The glow generated by light element 139 adds a decorative touch to the traditional use of a dust ruffle.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A traverse support rod comprising:

a generally tubular member having a first end and a second end, a substantially horizontal divider dividing said tubular member into a top portion and a bottom portion, and a longitudinal opening formed in said bottom portion and extending from said first end to said second end;

an attachment member slidably receivable within said tubular member including a glider configured to be slidably received and retained within said bottom portion of said tubular member and a clip removably coupled to said glider, extending through said longitudinal opening;

said clip having a split ring with a first end and an adjacent second end, each expandable one from the other; and a first locking member and a second locking member each including a stem extending from said first end and said second end of said split ring respectively, and an engagement portion removably coupling said clip to said glider.

2. A traverse support rod as claimed in claim 1 wherein said glider further includes:

a convex surface;

an inset surface opposing said convex surface; and an opening extending between said convex surface and said inset surface.

3. A traverse support rod as claimed in claim 2 wherein said stems each have a generally semi-circular cross-section with a curved surface and adjacent, parallel surfaces when said ends of said split ring are in an unexpanded position, said engagement portion includes threads formed on said curved surface of each stem for threadable engagement with said opening of said glider.

4. A traverse support rod as claimed in claim 2 wherein said clip is deformable between a locking position and an unlocking position, said engagement portions of said first and second locking members interact to have a combined width greater than a width of said opening in the locking position, and less than said width of said opening in the unlocking position.

5. A traverse support rod as claimed in claim 2 wherein said tubular member further includes:

a second longitudinal opening formed in said top portion, defined by opposing edges;

a decorative cap removably attachable to said tubular member for closing said second longitudinal opening; and said decorative cap having opposing edges configured to engage said opposing edges of said top portion.

6. A traverse support rod as claimed in claim 5 further including a light element carried within said top portion and a power source for powering said light element.

7. A traverse rod comprising:

an elongate, generally tubular member having a first end and a second end;

a substantially horizontal divider dividing said tubular member into a top portion and a bottom portion;

a longitudinal opening formed in said bottom portion and extending from said first end to said second end;

a second longitudinal opening formed in said top portion, defined by opposing edges;

a decorative cap removably attachable to said tubular member for closing said second longitudinal opening;

said decorative cap having opposing edges configured to engage said opposing edges of said top portion;

an attachment element slidably received by said tubular member; and a light element carried by said tubular member.

8. A traverse rod as claimed in claim 7 further including a power source for powering said light element.

9. A traverse support rod as claimed in claim 8 wherein said attachment member includes:

a glider configured to be slidably received and retained within said bottom portion of said tubular member; and a clip removably coupled to said glider, extending through said longitudinal opening.

10. A traverse support rod as claimed in claim 9 wherein said clip includes:

a split ring having a first end, and an adjacent second end, each expandable one from the other;

a first locking member and a second locking member each including a stem extending from said first end and said second end of said split ring respectively, and an engagement portion removably coupling said clip to said glider.

11. A traverse support rod as claimed in claim 10 wherein said glider further includes:

a convex surface;

an inset surface opposing said convex surface; and an opening extending between said convex surface and said inset surface.

12. A traverse support rod as claimed in claim 11 wherein said stems each have a generally semi-circular cross-section with a curved surface and adjacent, parallel surfaces when said ends of said split ring are in an unexpanded position, said engagement portion includes threads formed on said curved surface of each stem for threadable engagement with said opening of said glider.

13. A traverse support rod as claimed in claim 11 wherein said clip is deformable between a locking position and an unlocking position, said engagement portions of said first and second locking members interact to have a combined width greater than a width of said opening in the locking position, and less than said width of said opening in the unlocking position.

14. A traverse support rod for supporting between two opposing surfaces, a sheet material having eyelets formed along an upper edge, said traverse support rod comprising:

a tubular member having a first end and a second end, a substantially horizontal divider dividing said tubular member into a top portion and a bottom portion, and a longitudinal opening formed in said bottom portion and extending from said first end to said second end;

a second longitudinal opening formed in said top portion, defined by opposing edges;

a decorative cap removably attachable to said tubular member for closing said second longitudinal opening;

said decorative cap having opposing edges configured to engage said opposing edges of said top portion;

an attachment element slidably received by said tubular member having a glider configured to be slidably received and retained within said bottom portion of said tubular member and a clip removably coupled to said glider, extending through said longitudinal opening and receivable through said eyelet of said sheet material; and a support fixture coupled to one of said opposing surfaces for supporting said tubular member between said opposing surfaces.

15. A traverse support rod as claimed in claim 14 wherein said clip further includes:

a split ring having a first end, and an adjacent second end, each expandable one from the other allowing insertion of one of said first and second ends of said split ring through said eyelets of said sheet material; and a first locking member and a second locking member each including a stem extending from said first end and said second end of said split ring respectively, and an engagement portion removably coupling said clip to said glider.

16. A traverse rod as claimed in claim 15 wherein said glider includes:

a convex surface;

an inset surface opposing said convex surface; and an opening extending between said convex surface and said inset surface.

17. A traverse support rod as claimed in claim 16 wherein said clip is deformable between a locking position and an unlocking position, said engagement portions of said first and second locking members interact to have a combined width greater than a width of said opening in the locking position, and less than said width of said opening in the unlocking position.

18. A traverse support rod as claimed in claim 17 further including a light element carried within said top portion and a power source for powering said light element.

19. A traverse support rod as claimed in claim 18 wherein said support fixture includes:

a disk having a front surface, attachable to one of said opposing surfaces; and a semi-circular extension extending from said front surface for receiving said bottom portion of one end of said tubular member.

* * * * *